United States Patent [19]

Anderson

[11] Patent Number: 4,841,303

[45] Date of Patent: Jun. 20, 1989

[54] LOW COST METHOD AND SYSTEM FOR AUTOMATICALLY STEERING A MOBILE DIRECTIONAL ANTENNA

[75] Inventor: Roy E. Anderson, Scotia, N.Y.

[73] Assignee: Mobile Satellite Corporation, Malvern, Pa.

[21] Appl. No.: 68,531

[22] Filed: Jul. 1, 1987

[51] Int. Cl.[4] ..... H01Q 3/00

[52] U.S. Cl. ..... 342/359

[58] Field of Search ..... 342/359

[56] References Cited

U.S. PATENT DOCUMENTS

| | | | |
|---|---|---|---|
| 2,700,106 | 1/1955 | Taylor | 342/359 |
| 3,503,070 | 3/1970 | Kompfner | 342/359 |
| 4,263,539 | 4/1981 | Barton | 342/359 |
| 4,630,056 | 12/1986 | Noguchi et al. | 342/359 |
| 4,725,843 | 2/1988 | Suzuki et al. | 342/359 |

*Primary Examiner*—Theodore M. Blum
*Assistant Examiner*—David Cain
*Attorney, Agent, or Firm*—Charles W. Helzer

[57] ABSTRACT

A low cost, automatic steering system and method of operation for mobile mounted, rotatable, directional antennas is described. The improved system and method provides a means to sense the direction of the satellite and also to determine changes in direction of the mobile vehicle on which the rotatable directional antenna is mounted, and uses those items of information to point the antenna toward the satellite and to maintain the pointing of the directional antenna as the vehicle changes speed and/or direction and during periods when the received communication signal is degraded or interrupted. The novel system and method separates the signal sampling for steering purposes from the antenna scanning for communication signal reception and replaces gyroscopes or magnetic compasses used with prior art systems to obtain directional information by deriving directional information from the action of the vehicle as determined by its steering mechanism and speedometer or equivalent devices. The system and method thus eliminates any effect on signal quality while optimizing signal sampling rate for steering purposes. It eliminates the need for costly gyroscope and avoids problems encountered with magnetically operated systems due to magnetic variation and deviation. The invention further uses the means for sensing changes in direction of the vehicle and pointing direction of the directional antenna to the satellite in such a manner that enables the system to be made self-calibrating. The design of the system is such that it is low in cost and appropriate to communication satellite mobile applications.

21 Claims, 1 Drawing Sheet

LOW COST METHOD AND SYSTEM FOR AUTOMATICALLY STEERING A MOBILE DIRECTIONAL ANTENNA

TECHNICAL FIELD

This invention relates to an improved, low cost, automatic steering system and method of operation for mobile mounted rotatable directional antennas.

More particularly, the invention relates to a mobile, rotatable directional antenna automatic steering system and method of operation for causing a rotatable, directional antenna to automatically track a geostationary communication satellite during movement of a vehicle having the directional antenna rotatably mounted thereon.

BACKGROUND PRIOR ART PROBLEM

Communications through geostationary satellites with mobile vehicles on or around the earth's surface is best done if the antenna on the vehicle is directional in that a received signal will have higher gain than if a non-directional antenna is used. However, the directional antenna must be continuously pointed toward the satellite as the vehicle moves and changes directions. It is also advantageous if the directional antenna continues to point in the direction of the satellite even if the signal path between the vehicle and the satellite is interrupted which occurs when the vehicle passes through a tunnel or under an overpass or otherwise is in the vicinity of an interfering building or other objects which tend to impede or otherwise adversely affect the received signal strength.

Prior known means to steer mobile antennas toward satellites have used continuous measurements of a signal received from the satellite to determine the direction to the satellite and to couple this continuously received signal with a servo mechanism which maintains pointing of the antenna toward the satellite. Signal measurement means for this purpose have included monopulse and antenna beam lobing techniques. Such means are usually complex, expensive and require a new acquisition of the signal after each period of signal interruption for antenna steering purposes. This known means may also require signal sampling rates that are within the bandwidth of the information contained in the received communication signal and thus may adversely affect the quality of the communication signals. These prior art means also have been known to employ a gyroscope or compass or other similar means to provide a direction reference that then is used to maintain pointing during periods of signal loss or degradation. See for example U.S. Pat. No. 4,630,056 issued Dec. 16, 1986 for a "Control System for Antenna of Receiving Equipment Installed on Moving Body". Gyroscopes suitable for application of this nature are generally too costly for many of the potential mobile satellite services. Magnetic compasses are subject to unacceptable directional error due to mechanical instabilities variable declinations of the earth's magnetic field and to deviation and variation due to magnetic materials in the vicinity of the magnetic compass.

In order to overcome a number of the known problems encountered with prior art directional antenna steering systems including their relatively high cost, the present invention was devised.

SUMMARY OF INVENTION

The present invention provides an improved, low cost system and method for automatically steering a mobile antenna. This improved system includes a means to sense the direction of a geostationary satellite using the received signal and also to determine the changes in direction of the vehicle on which the mobile antenna is mounted, its speed and time of travel, and to use this data to automatically point the directional antenna towards the satellite and to maintain that pointing as the vehicle changes direction and during periods when the received signal is degraded or interrupted.

Another objective of the invention is to use the above briefly described method and means for sensing changes in direction of the vehicle and automatically controlling the pointing direction of the rotatable directional antenna to the satellite in such a way that enables the overall system to be self-calibrating.

It is a further objective of the invention to provide an improved mobile antenna automatic steering system that is low in cost and appropriate for satellite mobile communication applications.

The invention in operation separates signal sampling for steering purposes from the antenna scanning for communication signal receiving purposes, and replaces the gyroscope or compass normally used with such systems with directional information derived from the action of the vehicle as determined by its steering mechanism and speedometer or equivalent devices. The invention thus eliminates any possible adverse effect on received signal quality while optimizing the signal sampling rate. Further, the invention eliminates the need for a costly gyroscope and avoids problems of magnetic instability, variation and deviation where magnetic compasses are employed for directional determining purposes.

In practicing the invention a low cost system and method is provided for automatically steering a mobile mounted, rotatable, directional antenna for automatically causing the directional antenna to track a geostationary satellite during movement of a vehicle having the rotatable directional antenna rotatably mounted thereon. This improved system and method employs an automatic control system comprising:

(a) reversible servo drive motor means mountable on the vehicle for rotating the directional antenna in azimuth;

(a) antenna rotational position sensing and signal deriving means mountable on the vehicle for developing a first electric signal representative of the actual angular heading of the rotatable directional antenna measured with respect to an arbitrary starting position;

(c) vehicle speed sensing and signal deriving means mountable on the vehicle for developing a vehicle speed indicating signal representative of the speed of the vehicle on which the rotatable directional antenna is mounted;

(d) vehicle turn sensing and signal deriving means mountable on the vehicle for developing a vehicle turn signal representative of the magnitude and direction of each turn made by the vehicle measured with respect to an aribitrary initial position defined by the normal front end of the vehicle in a straightforward heading condition;

(e) communication signal receiving means coupled to the directional antenna for receiving and processing communication signals detected by the antenna; and (f) microprocessor means having at least a clock, a mathematical equation processing unit and a memory and a plurality of input terminals respectively coupled to the outputs from the communication signal receiving means, the vehicle turn sensing and signal deriving means, the vehicle speed sensing and signal deriving means and the antenna rotational position sensing and signal deriving means, and having its output connected to control operation of the reversible servo drive motor means; said method comprising:

(i) initially rotating the directional antenna over substantially a full 360 degree scanning angle via the reversible servo drive motor means under the control of the microprocessor means;

(ii) intermittenly sampling the signal strength of the carrier of a received communication signal with the communication signal receiving means at a sampling rate higher than any expected rate of communication signal variation;

(iii) recording the results of the sampling at each incremental angular position of the directional antenna in memory in the microprocessor along with the respective directional antenna heading derived from said antenna rotational position sensing and signal deriving means for each sampled signal;

(iv) comparing the received signal carrier magnitudes for each sampled heading of the directional antenna within the microprocessor means and specially recording in memory the respective antenna heading from which the maximum received carrier strength signal was derived;

(v) controlling the operation of the reversible servo drive motor means with the microprocessor to cause it to rotate the directional antenna so that it bears on the respective heading from which the maximum received carrier strength signal was derived; and (vi) processing in the microprocessor means the input signal from said vehicle speed sensing and signal deriving means together with the input signal from the vehicle turn sensor and signal deriving means to develop an antenna azimuth heading correction for combining with the last known directional antenna azimuth setting for maximum received signal amplitude for use in maintaining the pointing direction of the antenna as the vehicle changes direction and/or speed and during periods when the received signal is degraded or interrupted.

BRIEF DESCRIPTION OF DRAWINGS

These and other objects, features and many of the attendant advantages of this invention will be appreciated more readily as the same becomes better understood from a reading of the following detailed description, when considered in connection with the accompanying drawings, wherein like parts in each of the several figures are identified by the same reference characters and wherein.

BEST MODE OF PRACTICING INVENTION

Figure 1:
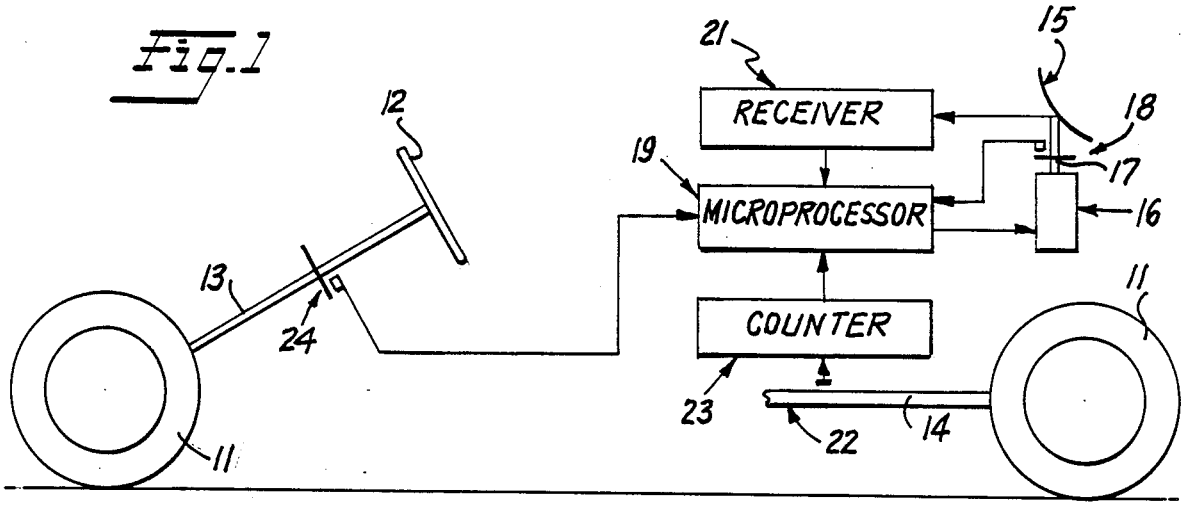
FIG. 1 is a schematic functional block diagram of a novel, low cost system and method for automatically steering a mobile directional antenna according to the invention.

FIG. 1 is a diagrammatic sketch of a land vehicle comprised by wheels 11, steering wheel 12, steering column 13 and drive shaft 14 and is intended to depict an automobile, van, truck or other comparable land vehicle on which a directional antenna shown at 15 is rotatably mounted. While the invention has been described with relation to a land vehicle, it is believed obvious that it can be praticed in connection with boats, airplanes or other suitable vehicles with which communication by radio linked with a geostationary satellite is desired. The antenna 15 may be comprised by a mechanical steerable mobile satellite antenna of the type described in U.S. application Ser. No. 774,154 filed Sept. 9, 1985 and assigned to Mobile Satellite Corporation, the assignee of the subject application. For a more detailed description of the construction and operation of the rotatable, directional antenna 15, reference is made to the above-noted pending U.S. application Ser. No. 774,154, the disclosure of which is hereby incorporated into this application. Briefly, however, it can be stated that the directional antenna is comprised by a center mounted emitter, horn dipole or the like r.f. signal radiating/collecting element, disposed within a parabolic or other similar directional reflector assembly. The r.f. signal radiator/collector and reflector 15 are mounted on a centrally disposed angularly bent flexible conduit or wave guide member which can be rotated by a suitable base member on which the assembly is mounted so as point to any desired direction within a 360 degree azimuth setting. The altitude angle at which the central flexible conduit or wave guide member is bent, may be adjusted by either a manually or automatically operated altitude adjusting bayonet-type variable lenght fixture as described in the above-noted application Ser. No. 774,154. The central rotatable base member can be rotated in azimuth in either direction and is driven by a reversible servo drive motor mounted within the base member and coupled to drive the base member through a suitable pinion and drive gear arrangement.

In FIG. 1, the directional antenna 15 is rotatable in azimuth over 360 degrees in either direction by a reversible servo drive motor 16 having its drive shaft 17 connected to rotatably drive the antenna 15. Antenna rotational position sensing and signal deriving means shown at 18 are provided for developing a first electric signal representative of the actual heading of the rotatable directional antenna 15 for any given angular position of the antenna. The angular heading (pointing direction) of the rotatable antenna is measured with respect to an arbitrary starting reference position, for example the normal front end of the vehicle 11–14 while it is in a straightfoward driving condition (i.e. straight ahead). The antenna rotational position sensing and signal deriving means 18 can constitute any known rotational sensing device for determining the angular position of the drive shaft 17 of reversible servo motor 16 at any given instant. The device can be either analog or digital since the invention can be praticed with either type of signal processing; however, in the specific embodiment of the invention here described, digital processing is preferred. For this reason, the pointing direction of antenna 15 is converted to a digital number by a code wheel 18 attached to the drive shaft 17 which coacts with either a magnetic or optical pickup element to derive the desired electric output signal representative of the actual angular heading (pointing direction) of the rotatable directional antenna 15. This signal is then supplied to a microprocessor 19 mounted within the vehicle 11-14 14.

Upon the vehicle with the steerable antenna being initially placed in operation (at the start of the day for example) reversible servo motor 16 is operated so as to cause antenna 15 to be rotated in azimuth through a full 360 degree sweep. The signal strength of the carrier of the communication received signal received from a satellite by the signal collector element of antenna 15 is then supplied to a communications receiver 21 for each stepped angular position setting in azimuth of antenna 15 by the digitally operated, reversible servo drive motor 16. The magnitude of the signal strength of the carrier of the received signal is then indicated by receiver 21 to microprosser 19 where it is stored in memory. The signal strength of the carrier of the received signal is sampled at a rate higher than any expected rate of communication signal variation, for exaple 200 samples per second. Each sampled signal is converted to a digital number for ease of processing by the microprocessor 19.

The pointing direction of the rotatable directional antenna 15 also is converted to a digital number by the code wheel and sensor element 18 attached to the drive shaft of the reversible servo motor 16. As noted above, this digital indication of rotational setting of the antenna 15 at ant given instant is also supplied to the microprocessor. The microprocessor is programmed to compare the magnitude of the carrier of the recieved signal for each angular positional setting of antenna 15 and to determine the antenna pointing direction at which the received signal strength is greatest. A memory circuit within the mocroprocessor 19 has this information stored in it and thereafter suitable programming causes the microprocessor through reversible drive motor 16 to set the angular position of antenna 15 of the particular code wheel 18 reading at which the maximum signal was received. Antenna 15 then is operated at the selected angular position setting until it is further adjusted as described hereafter, or its angular position setting is recalibrated in a manner also described hereafter.

A suitable speedometer-type device continuously measures the speed of the vehicle 11–14. The speed measuring device shown at 22 preferably may be a code wheel and sensor type device that generates a digital pulse for each rotation of the device shaft 14 or wheel 11 of the vehicle with each pulse being applied to a suitable counter 23 that counts at some high rate, such as 1 megahertz, with the counter 23 being reset by every pulse indicating a full wheel rotation. The counter output at reset therefore is a digital number representing the speeds, of the vehicle at any given instant of time.

Figure 2:
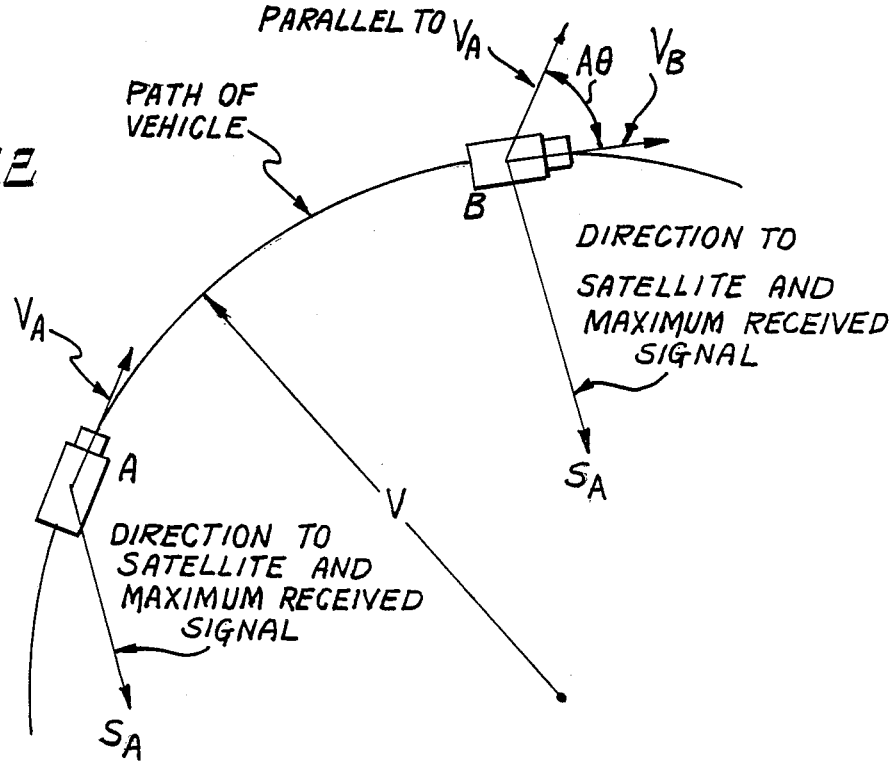
FIG. 2 is a partial schematic drawing illustrating various input operating parameters developed by the system and method of the invention to automatically continuously point or steer a directional antenna towards a geostationary communication satellite according to the invention.

Vehicle turn sensing and signal deriving means are pivotal in the form of a second digital code wheel 24 attached to the steering column 13 of the vehicle. The angular positioning of the steering column 13 is continuously applied to a further input of microprocessor 19 via the digital code wheel 24. The angular position of the steering mechanism determines the turning radius of the vehicle and the speed of the vehicle determines the rate at which the vehicle proceeds along the curved path such as shown in FIG. 2 from A to B. From these data it is a simple calculation for the microprocessor to determine the directional change of the vehicle at any given instant of time. This calculation is obtained through the following equation over the time T:

$$ST/2\pi r \times 360 = \Delta\theta \qquad (1)$$

where $\Delta\theta$ is the direcitonal change in degrees.

The factor r in equation (1) above is determined in the following manner. When the vehicle is travelling on a flat surface, the turning radius r is determined by the wheelbase length of the vehicle and the angle by which the front wheel are offset relative to the fore and aft centerline of the vehicle. The offset of the front wheels is a constant factor, k, relative to the angular position of the steering shaft. The code wheel 24 reads the angular position of the steering shaft, which multiplied by k, gives the front wheel offset. The turning radius, r, of the vehicle on a flat surface is the wheelbase length of the vehicle divided by the sine of the front wheel offset angle $$r = \frac{B_L}{\sin(kR_5)} \qquad (2)$$

where $B_L$= wheelbase length of vehicle and $R_5$= reading of code wheel 24.

The factors k and $B_L$ may be permanently set into the microprocessor. However, the system is self calibrating, as explained hereinafter. The self calibrating feature corrects for differences in road banking characteristics which affect the amount the steering shaft must be turned in order to follow a curve. The self calibrating feature will also respond to the wheelbase length of the vehicle. The preferred embodiment of the invention includes a memory associated with the microprocessor that retains the last calibration even during periods when the vehicle is not in use.

After completing the calculation for $\Delta\theta$, the microprocessor 19 causes the reversible servo drive motor 16 to drive antenna 15 to a new pointing direction by adding this angular change to the exisiting antenna pointing direction orginally obtained from the initial scanning of the antenna while the vehicle was in an at rest condition. Thus the pointing direction of the antenna can be adjusted so as to continuously point at the geostationary satellite and is thus controlled independently of the received communicaiton signal. Further, the antenna will continue to be pointed in the direction of the satellite even during the periods when the communication signal is not present due to the fact that the vehicle is passing through a tunnel or during periods of severe signal degradation due to the presence of large adjacent buildings or other environmental conditions affecting received signal magntiude. Further, it will be further appreciated that the received signal strength or amplitude can be sampled and measured using the receiver in conjunction with the microprocessor without introducing any undesirable effects on the received signal modulation. Consequently, the recieved signal can be sampled at any desired rate even within the received signal base bandwidth without adversely affecting received signal modulation quality.

Figure 3:
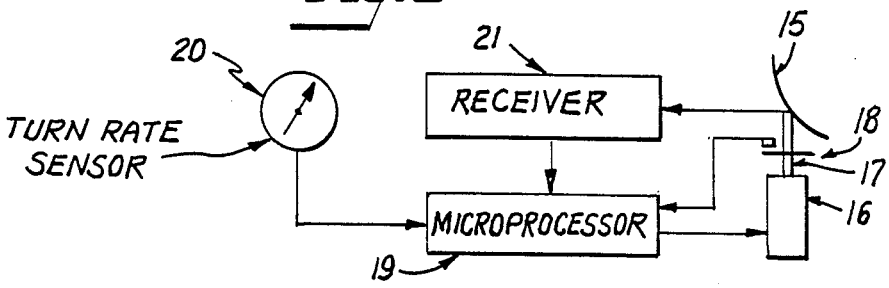
FIG. 3 is a schematic block diagram of a second embodiment of the invention which employs either a piezolelectric turn rate sensor or a flux gate compass.

The change in direction of the vehicle also can be determined by means other than a calculation based on turning radius, speed and time. Another means that could be used in a turn rate sensor 20 as shown in FIG. 3 whose output is supplied directly to the microprocessor 19. One known turn rate sensor means is a flux gate compass that measures the change in direction relative to the earth's magnetic field. Still another known turn rate sensor means is a piezoelectric rate sensor that measures rate of change of direction relative to inertial space. The devices are commercially available, compact, relatively inexpensive and rugged. The flux gate compass does not have the mechanical instabilities of the magnetic compass. In this application the effects of magnetic variation and deviation are not significant because the measurement is relative to the vehicle direction at the start of a turn and the measurement is completed at the end of the turn. Similarly, the precession of the piezoelectric rate sensor is not significant because the measurement is completed in the time required to make the turn. The invention permits the use of the inexpensive change of direction or turn rate sensors of this general type because it requires only measurement of direction change, not of true direction.

In addition to the above briefly-described basic code of operation which allows the system of the invention to maintain steering of the directional antenna 15 on the geostationary satellite even under periods of received signal loss or serious signal degradation, the automatic steering system and method of the invention further includes the feature of automatic recalibration to correct for accumulated errors under conditions where the system is operated over prolonged periods of time. Errors in the measurement of speed of the vehicle and steering, as mentioned earlier above, can and will cause accumulated errors in the automatic pointing or steering of the directional antenna. Consequently, at intervals shorter than the operating period of time in which an unacceptable error can accumulate, the microprocessor 19 via reversible servo drive motor 16 initiates a scan of the pointing direction of the antenna over a limited angular movement in either direction from its exisiting adjusted angular position at the point in time of initiation of the recalibration scan by the microprocessor. During this calibration scanning, directional antenna 13 is caused to move slowly first in one direction and then back in the other centered on the initial starting position at the initiation of the recalibration scan. If the received signal strength is observed to go down while the antenna is being scanned in a first direction, the direction of scan rotation then is reversed until the received signal definitely has passed through its peak value. The angular positional setting at which the received signal amplitude passed through its peak value is then stored in memory in the microprocessor which stores all measurements of signal amplitude versus pointing direction of the antenna. The microprocessor then selects the direction at which the received signal level was at a maximum and controls the reversible servo drive motor to cause it to set antenna 15 at the selected angular position setting corresponding to the maximum received signal amplitude. Thus, it will be appreciated that periodically at intervals of time shorter than that at which an unacceptable error can accumulate, the microprocessor automatically initiates a recalibration scan of the angular setting of directional antenna 15 which results in a new determination of the pointing direction for maximum signal reception from which further adjustments are made during movement of the vehicle as explained previously.

Received signal level at any pointing angle of the directional antenna 15 can and will change with time due to multipath fading and other similar causes. In mobile satellite communication service the amount of fading due to multipath phenomenon will be on the order of 1 decibel, depending on antenna directivity and the surroundings of the vehicle. Foilage in the vicinity of the mobile satellite vehicle may cause greater fading as do obstructions such as large buildings along the roadway which may cause short periods of severe signal degradation or signal dropout. Multipath fading may be on the order of 100 hertz, with generally slower rates for other causes. The sampling rate of the received communication signal for beam steering purposes is chosen to be higher than the maximum fade rate, or about 200 hertz as mentioned earlier. Averaging the measurements at each increment of pointing direction also improves the resolution of the measurement. For example, if the fade characteristic is Gausian in nature, the resolution is improved by the square root of the number of samples. Since the scan and sampling rates are chosen independently by the novel system and method herein described, they can be optimized for conditions that will be encountered in the service area where the system will be used. Because of this good resolution, the directional antenna can be scanned off its peak value angular positional setting if the divergence is small, and the pointing angle correction process described above can be completed well within the fade margin allowance for the communication link being served and its effect on received signal quality is not significant.

In addition to the above features of the novel direction antenna automatic steering method and system according to the invention, the system can be made to be somewhat self-calibrating in the following manner. The microprocessor 19 is programmed so that it records the magnitude of pointing error developed as a function of the change in direction of the vehicle on which the rotatable directional antenna 15 is mounted. This magnitude of pointing error as a function of the change in direction of the vehicle then can be used after a few cycles of operation to change the multiplication factor on speed and/or steering to improve the accuracy of repointing of the directional antenna as the vehicle changes speed or direction in the above-described manner. In this way, the system is made to be self-calibrating. The changes in the multiplication factor on speed and/or steering in this manner can be an iteritive process whereby the magnitude of pointing error as a function of change in direction of the vehicle is gradually reduced towards zero by the microprocessor to thereby improve calibration of the system operation.

INDUSTRIAL APPLICABILITY

The invention finds application in mobile communication service via a geostationary satellite and a mobile unit such as a van or truck, boat or plane on the surface of the earth. Since mobile communications through satellites is best achieved with directional antennas on board the vehicle, the invention provides a means for sensing the direction to the satellite and also to determine the changes in direction of the vehicle and uses those items of information of continuously point the antenna towards the satellite and maintains the pointing as the vehicle changes direction and during periods when the received communication signal is degraded or interrupted.

Having described several embodiments of a low cost system and method for automatically steering a mobile directional antenna constructed in accordance with the invention, it is believed obvious that other modifications and variations of the invention will be suggested to those skilled in the art in the light of the above teachings. It is therefore to be understood that changes may be made in the particular embodiments of the invention described which are within the full intended scope of the invention as defined by the appended claims.

What is claimed is:

1. A, automatic steering control system for a mobile mounted, rotatable, directional antenna for automatically causing the directional antenna to track a geostationary satellite during movement of a vehicle having the directional antenna rotatably mounted thereon, said antenna steering control system comprising:

(a) reversible servo drive motor means mountable on the vehicle for rotating the directional antenna in azimuth in either direction;

(b) antenna rotational position sensing and signal deriving means mountable on the vehicle for developing a first electric signal representative of an actual angular heading of the rotatable directional antenna measured with respect to an arbitrary starting position;

(c) vehicle turn sensing and signal deriving means mountable on the vehicle for developing a vehicle turn signal representative of the magnitude and direction of each turn made by the vehicle measured with respect to an arbitrary initial starting position;

(d) communication signal receiving means coupled to the directional antenna for receiving and processing communication signals detected by the antenna; and (e) microprocessor means having at least a clock, a mathematical equation processing unit and a memory and a plurality of input terminals respectively coupled to the outputs from the communication signal receiving means, the vehicle turn sensing and signal deriving means and the antenna rotational position sensing and signal deriving means, and having its output connected to control operation of the reversible servo drive motor means;

(f) said microprocessor means being programmed to initially rotate the directional antenna over substantially a full 360 degree scanning angle via the reversible servo drive motor means while intermittently sampling the signal strength of the carrier of a received communication signal with the communication signal receiving means to a sampling rate higher than any expected rate of communication signal variation, and recording the results in memory in the microprocessor along with a respective directional antenna heading derived from said antenna rotational position sensing and signal deriving means for each sampled signal;

(g) said microprocessor means also being programmed to compare received signal carrier magnitudes for each sampled heading of the directional antenna and specially recording in memory the respective antenna heading from which the maximum received carrier strength signal was derived, and controlling operation of the reversible servo drive motor means to cause it to rotate the directional antenna so that it bears on the respective heading from which the maximum received carrier strength signal was derived; and (h) said micro-processor means also being further programmed to process an input signal from said vehicle turn sensor and signal deriving means to develop an antenna azimuth heading correction for combining with the last known directional antenna azimuth setting for maximum received signal amplitude for use in maintaining the pointing direction of the antenna as the vehicle changes direction during periods when the received signal is degraded or interrupted.

2. A control system for a mobile mounted, rotatable, directional antenna according to claim 1 further including vehicle speed sensing and signal deriving means mountable on the vehicle for developing a vehicle speed indicating signal representative of the speed of the vehicle on which the rotatable directional antenna is mounted; and wherein the microprocessor means has its mathematical equation processing unit programmed to process the equation:

$$\Delta\theta = ST/2\pi r \times 360$$

where $\Delta\theta$ is the change in antenna pointing direction required to maintain the directional antenna pointed on the satellite in order to maintain maximum received signal strength as the vehicle turns, S is the speed of the vehicle, T is time and r is the turning radius of the circle around which the vehicle moves.

3. A control system for a mobile mounted, rotatable, directional antenna according to claim 1 wherein the turn sensing and signal deriving means comprises a turn rate sensor of the flux gate compass or piezoelectric rate sensor type that derives a turn indicating output signal that is supplied directly to an input of the microprocessor means.

4. A control system for a mobile mounted, rotatable, directional antenna according to claim 1 wherein the microprocessor means is programmed to automatically recalibrate the setting of the directional antenna in order to prevent accumulated errors in the pointing of the antenna due to errors in the measurements of turning angle periodically at intervals shorter than the period in which unacceptable errors can accumulate, and wherein the microprocessor initiates a new scanning operation of the directional antenna via the reversible servo drive motor means whereby the directional antenna is caused to move slowly in either direction from its setting at the point in time when the recalibration procedure is begun and the received signal level and pointing angle of the directional antenna are sensed and compared by the microprocessor whereby upon the received signal magnitude being reduced after passing through a peak value, the direction of scanning rotation is reversed until the received signal definitely has been determined to pass through a peak value by the comparison procedure effected by the microprocessor with the microprocessor storing all measurements of signal amplitude versus the antenna pointing direction whereupon the microprocessor automatically selects the antenna pointing direction at which the received signal is maximum and directs the reversible servo drive motor means to reset the directional antenna to point in the direction from which the maximum received signal level was obtained during the recalibration process.

5. A control system for a mobile mounted, rotatable, directional antenna according to claim 2 wherein the microprocessor means is programmed to automatically recalibrate the setting of the directional antenna in order to prevent accumulated errors in the pointing of the antenna due to errors in the measurements of speed and steering angle periodically at intervals shorter than the period in which unacceptable errors can accumulate, and wherein the microprocessor initiates a new scanning operation of the directional antenna via the reversible servo drive motor means whereby the directional antenna is caused to move slowly in either direction from its setting at the point in time when the recalibration procedure is begun and the received signal level and pointing angle of the directional antenna are sensed and compared by the microprocessor whereby upon the received signal magnitude being reduced after passing through a peak value, the direction of scanning rotation is reversed until the received signal definitely has been determined to pass through a peak value by the comparison procedure effected by the microprocessor with the microprocessor storing all measurements of signal amplitude versus the antenna pointing direction whereupon the microprocessor automatically selects the antenna pointing direction at which the received signal is maximum and directs the reversible servo drive motor means to reset the directional antenna to point in the direction from which the maximum received signal level was obtained during the recalibration process.

6. A control system for a mobile mounted rotatable directional antenna according to claim 1 wherein the sampling rate of the received signal during scanning of the directional antenna and during its subsequent operation interval is chosen to be higher than the maximum fade rate of the signal due to multipath fading and other causes and wherein the microprocessor is programmed to average the measurements of the received signal strength at each incremental pointing direction so as to improve resolution of the measurement.

7. A control system for a mobile mounted rotatable directional antenna according to claim 5 wherein the sampling rate of the received signal during scanning of the directional antenna and during its subsequent operation interval is chosen to be higher than the maximum fade rate of the signal due to multipath fading and other causes and wherein the microprocessor is programmed to average the measurements of the received signal strength at each incremental pointing direction so as to improve resolution of the measurement.

8. A control system for a mobile mounted, rotatable, directional antenna according to claim 1 wherein the microprocessor is programmed to record the magnitude of pointing error as a function of the change in direction of the vehicle on which the rotatable directional antenna is mounted and thereafter changes the processing factors used in the calculation to determine changes in direction to improve the accuracy of repointing the directional antenna as the vehicle changes direction so as make the system self-calibrating.

9. A control system for a mobile mounted, rotatable, directional antenna according to claim 6 wherein the microprocessor is programmed to record the magnitude of pointing error as a function of the change in speed and/or change in the direction of the vehicle on which the rotatable directional antenna is mounted and thereafter changes the multiplication factors for speed and/or steering turn to improve the accuracy of repointing the directional antenna as the vehicle changes direction so as make the system self-calibrating.

10. A automatic steering system for a mobile mounted, rotatable, directional antenna according to claim 1 wherein the reversible servo drive motor means in digitally operated and the antenna rotational position sensing and signal deriving means, and the vehicle turn sensing and signal deriving means all are digitally encoded for deriving digital output signals representative of the respective physical phenomenon they are designed to sense.

11. A automatic steering system for a mobile mounted, rotatable, directional antenna according to claim 9 wherein the reversible servo drive motor means is digitally operated and the antenna rotational position sensing and signal deriving means, the vehicle speed sensing and signal deriving means and the vehicle turn sensing and signal deriving means all are digitally encoded for deriving digital output signals representative of the respective physical phenomenon they are designed to sense.

12. A method for automatically steering a mobile mounted, rotatable, directional antenna for automatically causing the directional antenna to track a geostationary satellite during movement of a vehicle having the rotatable directional antenna rotatably mounted thereon; said method employing an automatic steering control system comprising:

(a) reversible servo drive motor means mountable on the vehicle for rotating the directional antenna in azimuth;

(b) antenna rotational position sensing and signal deriving means mountable on the vehicle for developing a first electric signal representative of the actual angular heading of the rotatable directional antenna measured with respect to an arbitrary starting position;

(c) vehicle turn sensing and signal deriving means mountable on the vehicle for developing a vehicle turn signal representative of the magnitude and direction of each turn made by the vehicle measured with respect to an arbitrary initial starting position;

(d) communication signal receiving means coupled to the directional antenna for receiving and processing communications signals detected by the antenna; and (e) microprocessor means having at least a clock, a mathematical equation processing unit and a memory and a plurality of input terminals respectively coupled to outputs from the communication signal receiving means, the vehicle turn sensing and signal deriving means and the antenna rotational position sensing and signal deriving means, and having its output connected to the control operation of the reversible servo drive motor means; said method comprising:

(i) initially rotating the directional antenna over substantially a full 360 degree scanning angle via the reversible servo drive motor means under control of the microprocessor means;

(ii) intermittently sampling the signal strength of the carrier of a received communication signal with the communication signal receiving means at a sampling rate higher than any expected rate of communication signal variation;

(iii) recording results of the sampling at each incremental angular position of the directional antenna in memory in the microprocessor along with a respective directional antenna heading derived from said antenna rotational position sensing and signal deriving means for each sampled signal;

(iv) comparing the received signal carrier magnitude for each sampled heading of the directional antenna with the microprocessor means and specially recording in memory the respective antenna heading from which the maximum received carrier strength signal was derived;

(v) controlling the operation of the reversible servo drive motor means with the microprocessor to cause it to rotate the directional antenna so that it bears on the respective heading from which the maximum received carrier strength signal was derived; and (vi) processing in the microprocessor means input signals from said vehicle turn sensor and signal deriving means to develop an antenna azimuth heading correction for combining with the last known directional antenna azimuth setting for maximum received signal amplitude for use in maintaining the pointing direction of the antenna as the vehicle changes direction and/or speed and during periods when the received signal is degraded or interrupted.

13. The method according to claim 12 wherein the automatic steering control system further comprises:

(f) vehicle speed sensing and signal deriving means mountable on the vehicle for developing a speed indicating signal representative of the speed of the vehicle on which the rotatable directional antenna is mounted; and wherein the microprocessor processes the equation:

$$\Delta\theta = ST/2\pi r \times 360$$

where $\Delta\theta$ is the change in antenna pointing direction required to maintain the directional antenna pointed on the satellite in order to maintain maximum received signal strength as the vehicle turns, S is the speed of the vehicle, T is time and r is the turning radius of the circle around which the vehicle moves.

14. The method according to claim 12 wherein the microprossor automatically recalibrates the setting of the directional antenna in order prevent accumlated errors in the pointing of the antenna due to errors in the measuments of steeing angle periodically at intervals shorter than the peroid in which unacceptable errors can accumulate, and wherein during the recalibration the microprocessor initiates a new scanning operation of the directional antenna via the reversible servo drive motor means whereby the directional antenna is caused to move slowly in either direction from its setting at the point in time when the recalibration procedure is begun and the received singal level and pointing angle of the directional antenna are sensed and compared by the microprocessor whereby upon the received signal magnitude being reduced after passing through a peak value, the direction of scanning rotation is reversed until the received signal definitely has been determined to pass through its peak value by the comparison procedure effected by the microprocessor with the microprocessor storing all measurements of signal amplitude versus the antenna pointing direction whereupon the microprocessor automatically selects the antenna pointing direction at which the received signal is maximum and directs the reversible servo drive motor means to reset the directional antenna to point in the direction from which the maximum received signal level was obtained during the recalibration procedure.

15. The method according to claim 13 wherein the microprocessor automatically recalibrates the setting of the directional antenna in order to prevent accumulated errors in the pointing of the antenna due to errors in the measurements of speed and steering angle periodically at intervals shorter than the period in which unacceptable errors can accumulate, and wherein during the recalibration procedure the microprocessor initiates a new scanning operation of the directional antenna via the reversible servo drive motor means whereby the directional antenna is caused to move slowly in either direction from its setting at the point in time when the recalibration procedure is begun and the received signal level and pointing angle of the directional antenna are sensed and compared by the microprocessor whereby upon the received signal magnitude being reduced after passing through a peak value, the direction of scanning rotation is reversed until the received signal definitely has been determined to pass through its peak value by the comparison procedure effected by the microprocessor with the microprocessor storing all measurements of signal amplitude versus the antenna pointing direction whereupon the microprocessor automatically selects the antenna pointing direction at which the received signal is maximum and directs the reversible servo drive motor means to reset the directional antenna to point in the direction from which the maximum received signal level was obtained during the recalibration procedure.

16. The method according to claim 14 wherein the sampling rate of the received signal during scanning of the directional antenna and during the subsequent operation interval is chosen to be higher than the maximum fade rate of the signal due to multipath fading and other causes and wherein the microprocessor is programmed to average the measurements of the received signal strength at each incremental pointing direction so as to improve resolution of the measurement.

17. The method according to claim 15 wherein the sampling rate of the received signal during scanning of the directional antenna and during its subsequent operation interval is chosen to be higher than the maximum fade rate of the signal due to multipath fading and other causes and wherein the microprocessor is programmed to average the measurements of the received signal strength at each incremental pointing direction so as to improve resolution of the measurement.

18. The method according to claim 16 wherein the microprocessor records the magnitude of pointing error as a function of the change in the direction of the vehicle on which the rotatable directional antenna is mounted and thereafter changes the processing factors for calculating change in direction due to a turn to improve the accuracy of repointing the directional antenna as the vehicle changes direction so as make the system self-calibrating.

19. The method according to claim 17 wherein the microprocessor records the magnitude of pointing error as a function of the change in speed and/or in the direction of the vehicle on which the rotatable directional antenna is mounted and thereafter changes the multiplication factors for speed and/or steering turn to improve the accuracy of repointing the directional antenna as the vehicle changes direction so as make the system self-calibrating.

20. The method according to claim 18 wherein the reversible servo drive motor means is digitally operated and the antenna rotational position sensing and signal deriving means, and the vehicle turn sensing and signal deriving means all are digital encoders for deriving digital output signals representative of the respective physical phenomenon they are designed to sense.

21. The method according to claim 19 wherein the reversible servo drive motor means is digitally operated and the antenna rotational position sensing and signal deriving means, the vehicle speed sensing and signal deriving means and the vehicle turn sensing and signal deriving means all are digital encoders for deriving digital output signals representative of the respective physical phenomenon they are designed to sense.

* * * * *